US012410672B2

(12) United States Patent
Karadeniz et al.

(10) Patent No.: US 12,410,672 B2
(45) Date of Patent: Sep. 9, 2025

(54) SYSTEM AND METHOD FOR REMOTE OPERATION OF WELL EQUIPMENT

(71) Applicant: TECHNIPFMC NORGE AS, Kongsberg (NO)

(72) Inventors: Firat Karadeniz, Kongsberg (NO); Thomas Doran, Kongsberg (NO); Kjetil Halset, Kongsberg (NO); Jonathan Morley, Conroe, TX (US); Ameuri Mahfoudh, Kongsberg (NO)

(73) Assignee: TECHNIPFMC NORGE AS, Kongsberg (NO)

( * ) Notice: Subject to any disclaimer, the term of this patent is extended or adjusted under 35 U.S.C. 154(b) by 0 days.

(21) Appl. No.: 18/708,725

(22) PCT Filed: Nov. 9, 2021

(86) PCT No.: PCT/EP2021/081036

§ 371 (c)(1),
(2) Date: May 9, 2024

(87) PCT Pub. No.: WO2023/083432

PCT Pub. Date: May 19, 2023

(65) Prior Publication Data

US 2025/0003307 A1 Jan. 2, 2025

(51) Int. Cl.
*E21B 33/035* (2006.01)
*E21B 33/04* (2006.01)
(Continued)

(52) U.S. Cl.
CPC ..... *E21B 33/0355* (2013.01); *E21B 33/0415* (2013.01); *E21B 33/063* (2013.01); *E21B 47/13* (2020.05); *E21B 47/16* (2013.01)

(58) Field of Classification Search
CPC ..... E21B 33/0355; E21B 33/0415; E21B 33/063; E21B 47/13; E21B 47/16
See application file for complete search history.

(56) References Cited

U.S. PATENT DOCUMENTS 7,114,571 B2 * 10/2006 Gatherar ..... E21B 33/043 166/89.2
10,246,963 B2 4/2019 Dailey, Jr. et al.
(Continued)

FOREIGN PATENT DOCUMENTS

EP 3530872 A1 8/2019
WO 2016182449 A1 11/2016

OTHER PUBLICATIONS

International Search Report and Written Opinion from PCT/EP2021/081036, dated Jun. 28, 2022.

*Primary Examiner* — Aaron L Lembo
(74) *Attorney, Agent, or Firm* — Kevin E. West; Advent, LLP

(57) ABSTRACT

A system and a method for remote operation of a well equipment through a marine riser comprising a first module and a second module connectable to a landing string in the marine riser. The first module includes a communication module, batteries, and a control module; the second module includes a plurality of reservoirs for fluid, one or more pumps, a plurality of motors, a plurality of valves, and a control unit. The control module controls the one or more pumps, and the control unit controls the plurality of motors and the plurality of valves. The first module supplying electric power from the batteries of the first module to the one or more pumps and the plurality of motors of the second module, and the first module supplying communication data from the control module of the first module to the control unit of the second module.

20 Claims, 6 Drawing Sheets

(51) Int. Cl.

| | |
|---|---|
| ***E21B 33/06*** | (2006.01) |
| ***E21B 47/13*** | (2012.01) |
| ***E21B 47/16*** | (2006.01) |

(56) References Cited

U.S. PATENT DOCUMENTS

| | | | | |
|---|---|---|---|---|
| 10,246,972 | B2 * | 4/2019 | Flight | F03B 3/126 |
| 10,767,433 | B2 * | 9/2020 | Hussain | E21B 33/0355 |
| 10,837,251 | B2 * | 11/2020 | Foley | E21B 33/035 |
| 10,890,043 | B2 * | 1/2021 | Carlsen | E21B 47/12 |
| 11,208,862 | B2 * | 12/2021 | Maher | E21B 33/068 |
| 11,713,657 | B2 * | 8/2023 | Tusing | E21B 34/066 166/373 |
| 2005/0269096 | A1 * | 12/2005 | Milberger | E21B 33/043 166/308.1 |
| 2008/0110633 | A1 * | 5/2008 | Trewhella | E21B 33/04 166/336 |
| 2012/0061090 | A1 * | 3/2012 | Richards | E21B 21/08 166/345 |
| 2020/0157906 | A1 * | 5/2020 | Bourgeau | E21B 33/0355 |

* cited by examiner

SYSTEM AND METHOD FOR REMOTE OPERATION OF WELL EQUIPMENT

TECHNICAL FIELD

The present disclosure relates to a system and method for remote operation of a well equipment through a marine riser. More particularly, the present disclosure relates to a system and method for remote operation of a well completion equipment through a marine riser, without the use of an umbilical, such as used for tubing hanger installation, the umbilical comprising three lines, an electric power line, a hydraulic power line, and a communication line.

BACKGROUND

For operating remotely a well completion equipment, from a marine riser, a landing string and an umbilical is used. The umbilical has three lines, an electric power line, a hydraulic power line, and a communication line. These three lines provide electricity, pressurised fluid and control and all three are needed to operate the well equipment. WO2016/182449A1 may be useful for understanding the background art and show how the umbilical is used to operate the well equipment.

An installation of an upper completion is performed by utilising a simplified landing string, or a landing string, which runs inside a BOP with an umbilical which provides the link for communication and power, hydraulic and electrical, from the topside to the seabed through a drill pipe and special joints. Current technology requires the use of a significant length of umbilical. Sometimes up to 3000 meters depending on the depth of the field or well. Such an umbilical is a very high cost item in the upper completion system architecture.

One problem is to operate the well equipment not having to use an umbilical. To eliminate the use of the umbilical would save costs and time. The umbilical is expensive and it takes time to run the umbilical subsea. Often there is a space restriction or an environmental issues, where the system and method is used. A further problem is to reduced topside footprint and rig interfaces and increase the weather window when the system and method can be used. The system and method should also address one or more of the following: move work away from the red zone; avoid hands-on clamping/handling of umbilical; avoid offshore lifting/handling of reel on/off rig; avoid routing of and damage to umbilical; reduce dropped objects; reduced topside footprint and rig interfaces; and/or increased weather window.

A further problem is that any system and method should be adaptable to different marine rising systems. A system and method should be able to connect to different well equipment. A system and method should be connectable and usable with other tools and marine rising systems, such as for example standard joints inside the BOP. A system and method should not be dependent on the BOP.

It is also desirable to provide a system and method for remote operation of a well equipment through a marine riser that is inexpensive to manufacture, is easy to manufacture and assemble, and is robust and reliable. The system and method should also be able to provide a good and reliable operation of the well equipment. The present disclosure is directed to overcoming one or more of the problems as set forth above.

BRIEF DESCRIPTION OF THE DRAWINGS

The accompanying drawings illustrate presently exemplary embodiments of the disclosure, and together with the general description given above and the detailed description of the embodiments given below, serve to explain, by way of example, the principles of the disclosure.

DETAILED DESCRIPTION

Figure 1:
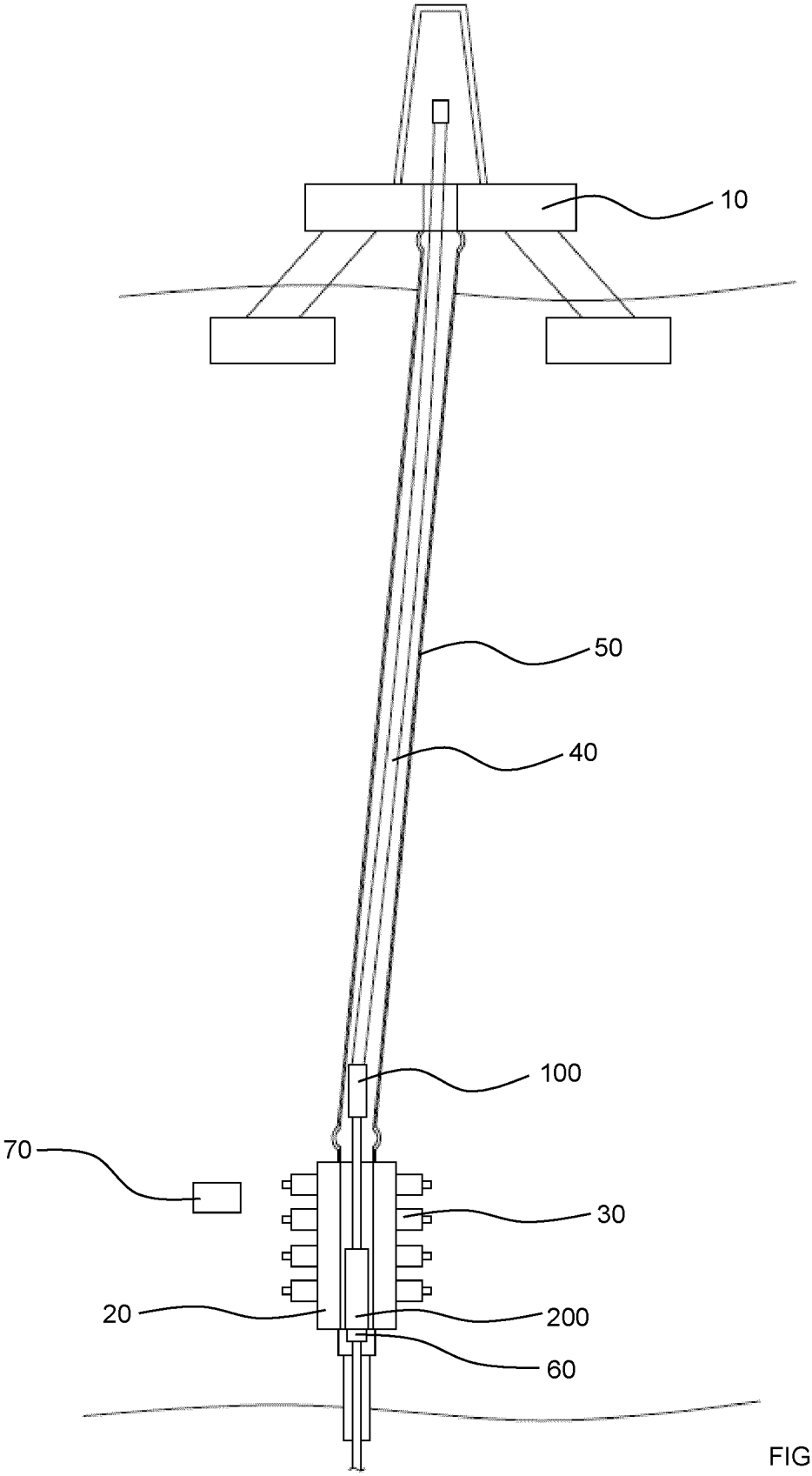
FIG. 1 is a diagrammatic illustration of an exemplary embodiment of a system and method for remote operation of a well equipment through a marine riser.

It is an object of the present invention to provide a system and method for remote operation of a well equipment through a marine riser. This object can be achieved by the features as defined by the independent claims. Further enhancements are characterised by the dependent claims.

According to one embodiment, a system for remote operation of a well equipment through a marine riser (50) is disclosed; the marine riser (50) extending between a blowout preventer, BOP, (20) attached to a well head (60) and a vessel or a rig (10) at the surface. An umbilical comprising three lines, an electric power line, a hydraulic power line, and a communication line, being excluded from the system for the remote operation of the well equipment. The system comprises a first module (100) and a second module (200) connectable to, may be part of, a landing string (40) in the marine riser (50). The first module (100) comprises a communication module (110), batteries (120), and a control module (130). The second module (200) comprises a plurality of reservoirs (210) for fluid, one or more pumps (290), a plurality of motors (240), a plurality of valves (250), and a control unit (260). The control unit (260) controls the plurality of motors (240), and the plurality of valves (250), and each valve (250) being configured for controlling functions of the well equipment and downhole equipment. The first module (100) is a separate module from the second module (200) along the landing string (40), the second module (200) being configured to be closer to the well head (60), or the tubing hanger, than the first module (100) along the landing string (40). The communication module (110) of the first module (100) is configured to receive communication data for controlling the one or more tools of the well equipment, the communication data being received from the vessel or the rig (10) at the surface. The first module (100) and the second module (200) are configured to have an electric cable (300) between them. The first module (100) supplying via the electric cable (300) electric power from the batteries (120), in the first module (100), to the one or more pumps (290) and the plurality of motors (240), in the second module (200). The first module (100) supplying via the electric cable (300) communication data from the control module (130), in the first module (100), to the control unit (260) and the one or more pumps (290), in the second module (200).

According to one embodiment, the second module (200) may further comprises a plurality of electro-hydrostatic power units (220), EPUs, and a plurality of intensifiers (230), each of the plurality of EPUs (220) may comprise one of the one or more pumps (290). The control module (130) of the first module (100) may control via the electric cable (300) each of the plurality of EPUs (220). The first module (100) may supply via the electric cable (300) electric power from the batteries (120), in the first module (100), to the plurality of EPUs (220).

According to one embodiment, the first module (100) and the second module (200) may be configured to be located within the blowout preventer, BOP, (20). According to one embodiment, only the second module (200), of the two modules (100, 200), may be configured to be located within the BOP (20).

According to one embodiment, the second module (200) may be configured to be located below a shear ram (30) in the BOP (20). In some embodiments, the second module is located below the lowest shear ram in the BOP (20).

According to one embodiment, the well equipment may be a tubing hanger orientation joint. According to one embodiment first module (100) and/or the second module (200) may comprise a protective cover.

According to one embodiment, the communication data sent from the vessel or rig (10) to the communication module (110) of the first module (100) may be communicated in one or more of the following ways: through-casing communication, in-riser acoustic communication, or wired drill pipe communication.

According to one embodiment, the second module (200) may further comprises a battery (270) that supplies electric power to the control unit (260).

According to one embodiment, the second module (200) may further comprise one or more annulus valves (280) for back up power using any pressure in the annulus between the BOP (20) and the landing string (40).

According to one embodiment, the second module (200) is arranged within at least part of, or completely, the well equipment. In some embodiments, the second module is arranged within a tubing hanger orientation joint.

According to one embodiment, a method of operating a well equipment with the system according to any one of the preceding embodiments is disclosed, without using an umbilical with an electric power line, a hydraulic power line, and a communication line. The method comprises arranging (410) the first module (100) further away from the well head than the second module (200) along the landing string; and connecting (430) and controlling hydraulic pressurised fluid to one or more tools of the well equipment via at least one valve (250) of the plurality of valves (250) of the second module (200).

According to one embodiment, the well equipment may be a tubing hanger orientation joint.

According to one embodiment, the method may further comprise communicating (440) the communication data, sent from the vessel or rig (10) to the communication module (110) of the first module (100), in one or more of the following ways: through-casing communication, in-riser acoustic communication, or wired drill pipe communication.

According to one embodiment, the method may further comprise locating (420) the first module (100) and the second module (200) within the BOP (20) by the landing string (40); or locating (420) only the second module (100) within the BOP (20) by the landing string (40).

According to one embodiment, the method may further comprise locating (420) the second module (200) below a shear ram (30) in the BOP (20). In some embodiments, the second module is located below the lowest shear ram in the BOP (20).

According to one embodiment, the method may further comprise using the pressure in the annulus as a back up pressurised fluid for operating the well equipment.

One or more embodiments disclosed herein provide a system and method for remote operation of a well equipment through a marine riser. At least one embodiment provides a system and/or a method that solves one or more of the following: move work away from the red zone; avoid hands-on clamping/handling of umbilical; avoid offshore lifting/handling of reel on/off rig; avoid routing of and damage to umbilical; reduce dropped objects due to no clamping; reduced topside footprint and rig interfaces; and/or increased weather window.

At least one of the above embodiments provides one or more solutions to the problems and disadvantages with the background art. Other technical advantages of the present disclosure will be readily apparent to one skilled in the art from the following description and claims. Various embodiments of the present application obtain only a subset of the advantages set forth. No one advantage is critical to the embodiments. Any embodiment disclosed herein may be technically combined with any other embodiment(s) disclosed herein.

Figure 2:
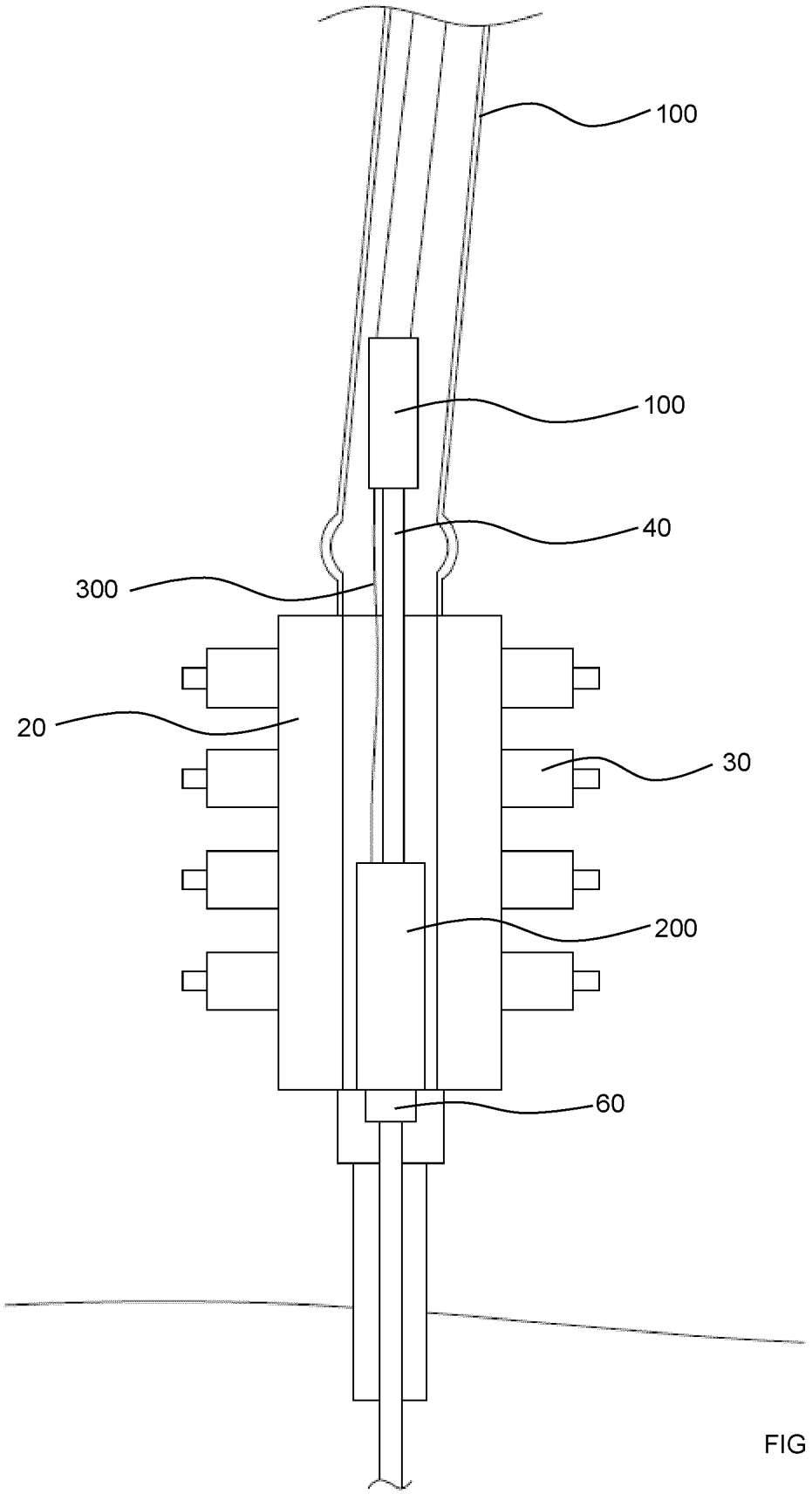
FIG. 2 is a diagrammatic illustration of an exemplary embodiment of a first module and a second module in relation to a BOP.

FIGS. 1 and 2 are diagrammatic illustrations of an exemplary embodiment of a system and method for remote operation of a well equipment through a marine riser. FIG. 1 illustrates a vessel or a rig (10) at a surface of a sea. A marine riser (50) extends between, and connects, the vessel or rig (10) and a blowout preventer, BOP, (20). The BOP (20) is attached to a well head (60) on the seabed. The BOP comprises a plurality of rams (30). A landing string (40) is used within the marine riser (50) for operating the well equipment. Contrary to the present disclosure, a conventional system uses an umbilical. An umbilical comprises three lines, an electric power line, a hydraulic power line, and a communication line. An umbilical is normally used for tubing hanger installation, but the umbilical is absent in the figures and an umbilical is excluded from the disclosed system and method for the remote operation of the well equipment. A remotely operated vehicle, a ROV, (70) is also illustrated in FIG. 1.

The system and method comprise a first module (100) and a second module (200) connectable to the landing string (40) in the marine riser (50). The first module (100) is separate from the second module (200). FIG. 1 illustrates the first module (100) within the marine riser (50) and the second module (200) within the BOP (20). The first module (100) may also be within, or partly within, the BOP (20). FIGS. 1 and 2 illustrate when the two modules (100, 200) are in use while operating a well equipment.

FIG. 2 illustrates that the first module (100) is a separate module from the second module (200) when viewed along the landing string (40). The second module (200) is closer to the well head (60), or tubing hanger, than the first module (100) along the landing string (40), when the system is used for reaching the well head and operating. Thus, the second module (200) may be closer to a tubing hanger than the first module (100). The first module (100) is an upper module and the second module (200) is a lower module. The first module (100) and the second module (200) are connectable to a landing string (40) in the marine riser (50). The first module (100) and the second module (200) may be part of the landing string (40) by attaching them to the landing string (40). The first module (100) and the second module (200)

may be configured as standard joints, or as part of standard joint, that are connectable to the landing string (40). While the first module (100) and the second module (200) are separate from each other, there is an electric cable (300) that connects them. The electric cable (300) may directly connect the two modules. The electric cable (300) may be run directly from the first module (100), through the annular space between the landing string (40) and the marine riser (50), and the annular space between the landing string (40) and the BOP (20), to the second module (200). The electric cable (300) may be routed through gun drillings in special joints (slick joints) of the landing string, for example a simplified landing string, and clamped on to the joint when through shear joints section of the landing string, simplified landing string. The electric cable (300) is used for transferring electric power and communication data between the two modules.

Figure 3:
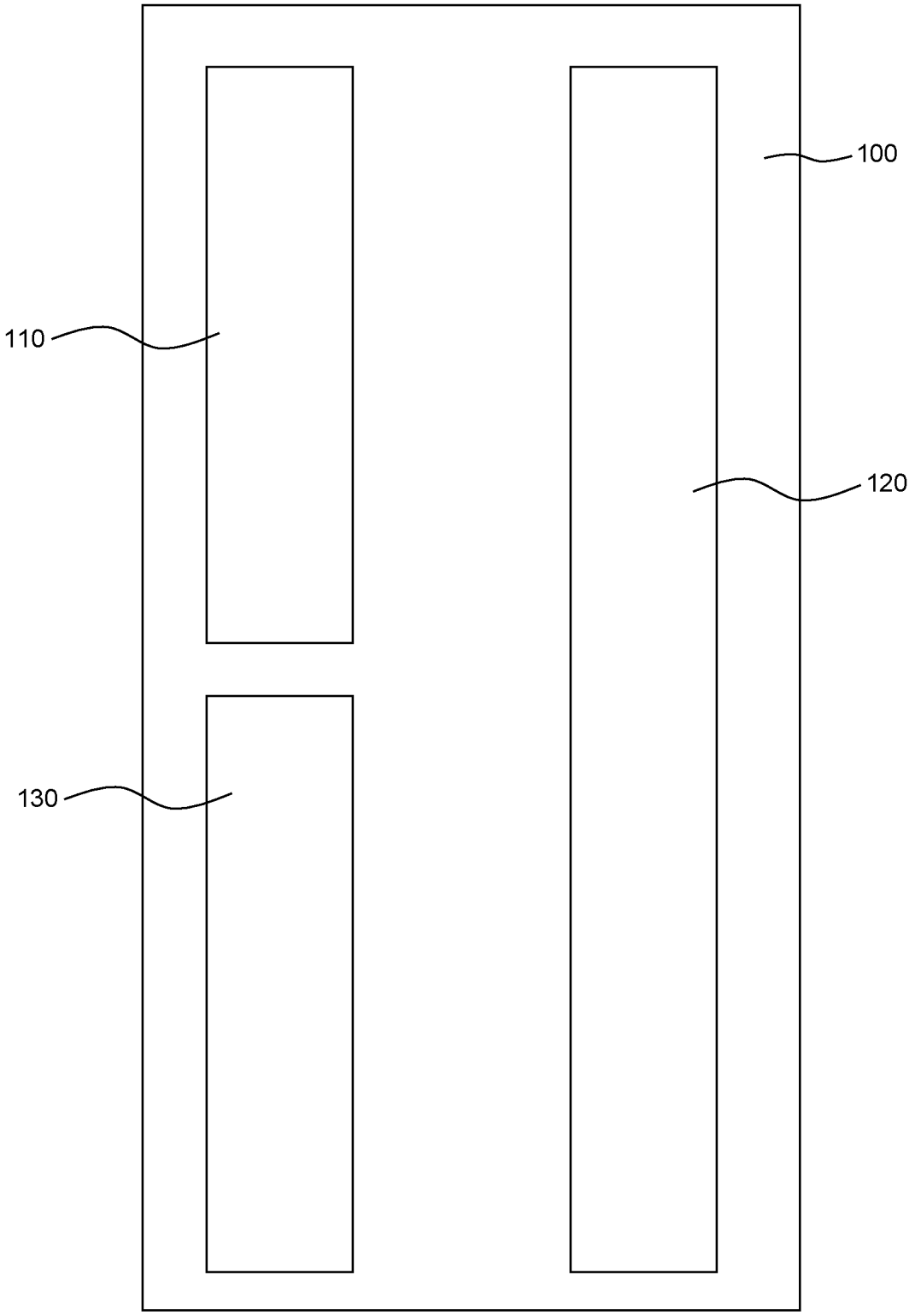
FIG. 3 is a diagrammatic illustration of an exemplary embodiment of a first module.

FIG. 3 illustrates an example of what the first module (100) comprises. The first module (100) comprises a communication module (110), batteries (120), and a control module (130). The communication module (110) may be a wireless communication module (110). The control module (130) may be an electronic control module (130). The communication module (110) is configured to communicate with the top side of the system, e.g. the vessel or the rig (10). The control module (130) is configured to communicate with the second module (200), via the electric cable (300), for example, to control the operation of the well equipment by controlling one or more of the valves (250). The control module (130) and the communication module (110) may be connected with each other by an electric cable for sending communication data to each other. The control module (130) and/or the communication module (110) may be connected with one or more of the batteries (120) by electric cables used for providing electric power to the control module (130) and/or the communication module (110). The electric cable (300) may connect to the control module (130) for the purpose of sending communication data to the second module (200). The electric cable (300) may connect to the batteries (120) for the purpose of providing electric power to the second module (200).

Figure 4:
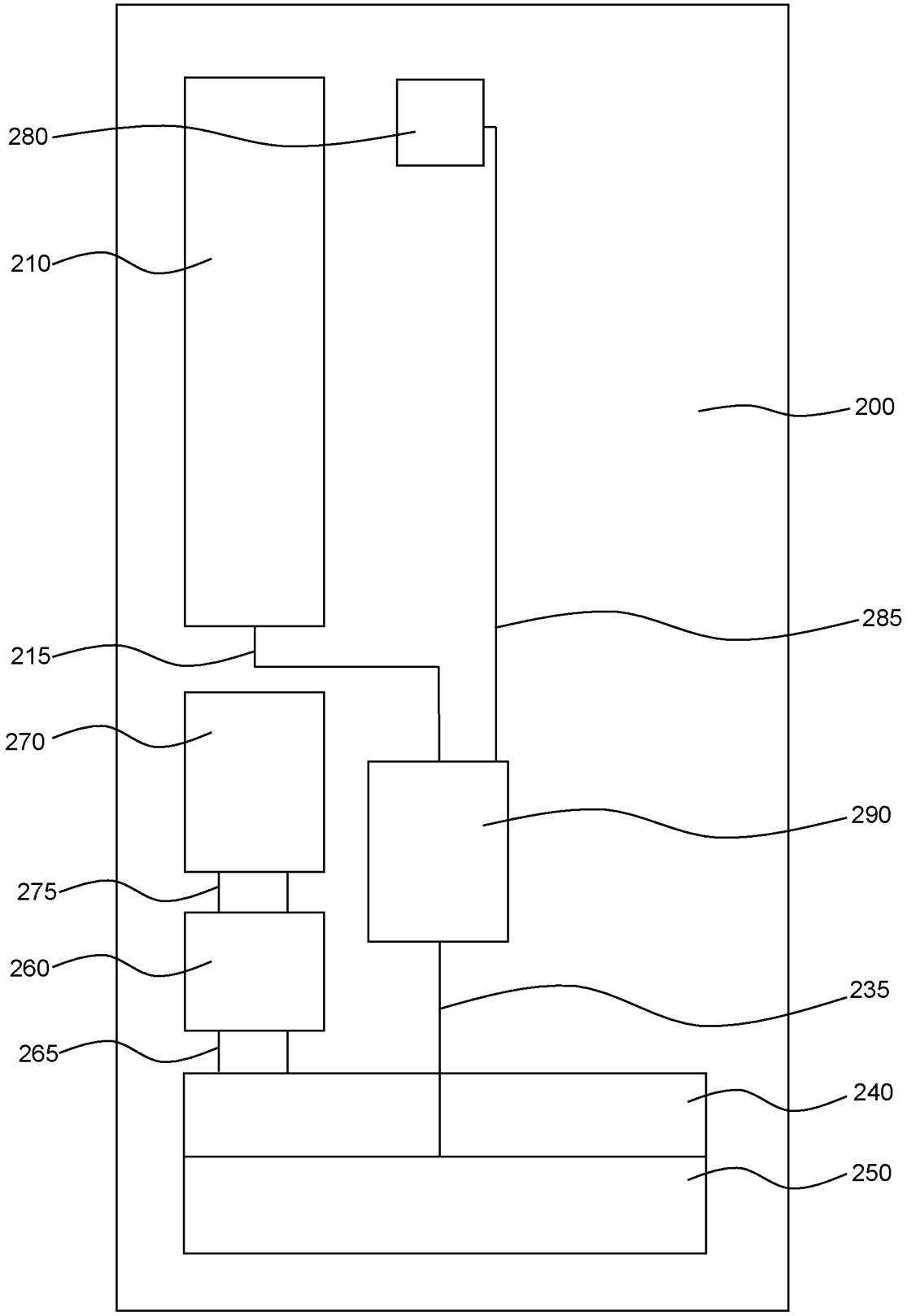
FIG. 4 is a diagrammatic illustration of an exemplary embodiment of a second module.
Figure 5:
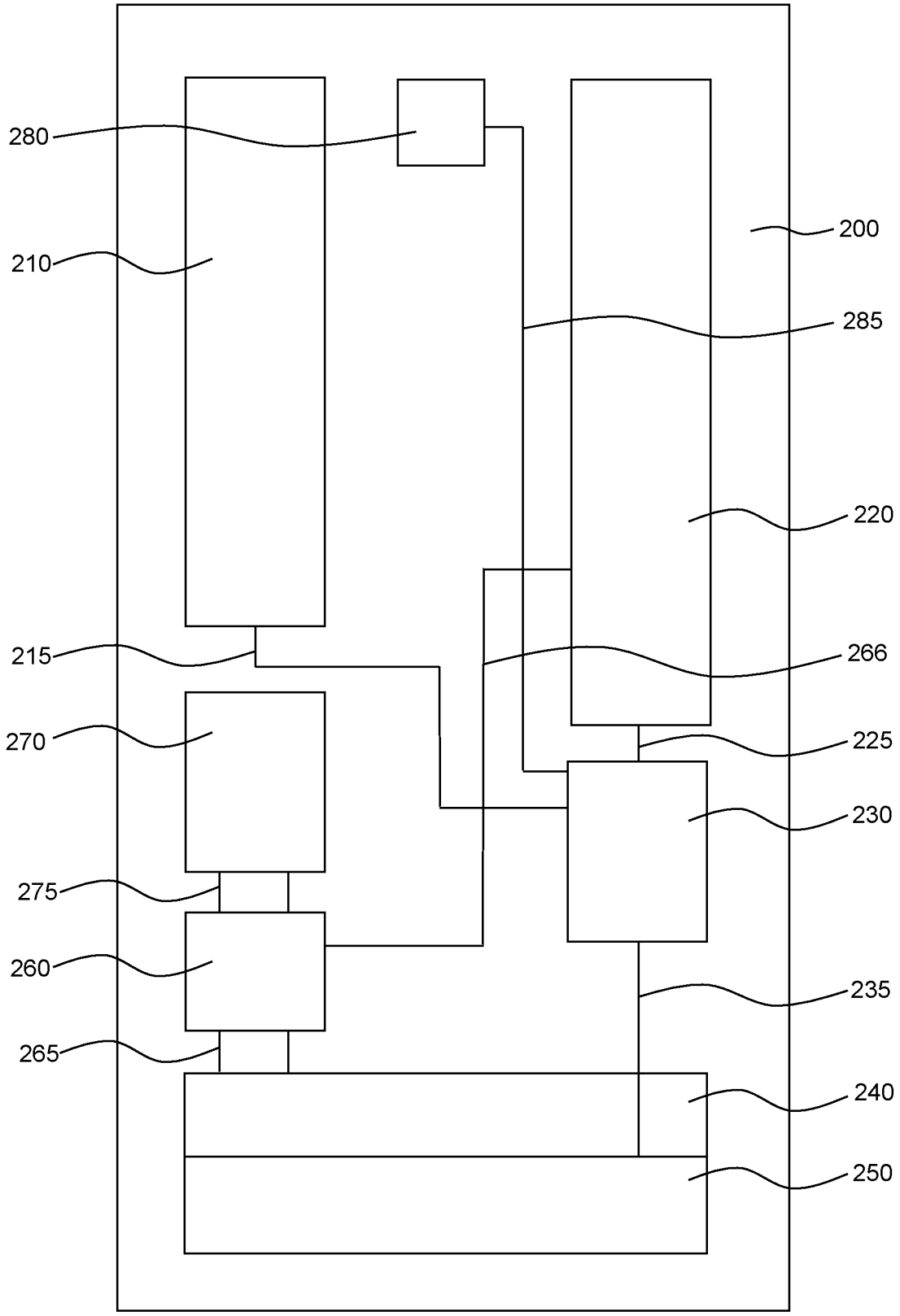
FIG. 5 is a diagrammatic illustration of an exemplary embodiment of a second module.

FIGS. 4 and 5 illustrate examples of what the second module (200) comprises. The second module (200) comprises a plurality of reservoirs (210) for fluid, one or more pumps (290), a plurality of motors (240), a plurality of valves (250), and a control unit (260). The control module (130) controls the one or more pumps (290) to produce low or high pressure fluid. The control unit (260) controls the plurality of motors (240) and the plurality of valves (250). Each valve (250) being configured for controlling functions of the well equipment, for example well completion equipment, and downhole equipment. Each valve (250) may be configured for controlling one or more tools of the well equipment. For each valve (250) there may be one motor (240) to control, open and close, the valve (250).

FIG. 4 illustrates how the reservoir (210) for fluid may be connected via a conduit (215) to the one or more pumps (290). The fluid in the reservoir (210) may be a hydraulic glycol, for example a mixture of water and glycol, such as ethylene or diethylene glycol, a water based hydraulic fluid. The fluid in the reservoir (210) may, or may not, be pressurised. The one or more pumps, for example one pump, may pump fluid from the reservoir (210) and provide low or high pressurised fluid to the one or more valves (250). The one or more pumps (290) receive electric power from the one or more batteries (120) via the electric cable (300). The one or more pumps (290) may be connected to one or more of the plurality of valves (250) via a conduit (235). One or more of the valves (250) are in turn connected to the well equipment so as to provide tools of the well equipment with pressured fluid for operating the well equipment and its tools.

FIG. 4 illustrates that the second module (200) may have a battery (270), one or more batteries (270), that are electrically connected via a cable (275) to the control unit (260). Hereby the control unit (260) may receive electric power from the battery (270) in addition to, or as an alternative to, receiving electric power via cable (300) from the batteries (120) in the first module (100). As a contingency, for example if the connection between the first module (100) and the second module (200) is cut, then the battery (270) may provide power to the control unit (260) in module (200). The control module (130) may control the one or more pumps (290) for pumping fluid from the reservoir (210) to the one or more valves (250). The control unit (260) may control the plurality of motors (240) via a cable (265). Hereby the control unit (260) may open or close the one or more valves (250), and may therefore control and operate the well equipment. The plurality of motors (240) may be electric motors (240). In some embodiments, the electric motors are electric step motors (240). Each electric motor (240) may receive electric power, via the electric cable (300), from the batteries (120) in the first module (100). For each valve (250) there may be one of the plurality of motors (240) that may operate, open or close, that valve (250).

The first module (100) and the second module (200) are configured to have the electric cable (300) between them, connecting the two. The first module (100) supplies via the electric cable (300) electric power from the batteries (120), in the first module (100), to the one or more pumps (290) and the plurality of motors (240), in the second module (200). The first module (100) supplies via the electric cable (300) communication data from the control module (130), in the first module (100), to the control unit (260) and the one or more pumps (290), in the second module (200).

FIG. 5 illustrates that the second module (200) may comprise the plurality of reservoirs (210) for fluid, a plurality of electro-hydrostatic power units (220), EPUs, a plurality of intensifiers (230), the plurality of motors (240), the plurality of valves (250), and the control unit (260). The plurality of motors (240) operates the plurality of valves (250) as described above. The control module (130) of the first module (100) controls, via the electric cable (300), each of the plurality of EPUs (220). The control unit (260) controls the plurality of motors (240) as described above. The control unit (260) may receive electric power from the battery (270) in addition to, or as an alternative to, receiving electric power via cable (300) from the batteries (120) in the first module (100). The control unit (260) may control the plurality of motors (240) via a cable (265). Hereby the control unit (260) may open or close the one or more valves (250), and may therefore control and operate the well equipment. Each electric motor (240) may receive electric power, via the electric cable (300), from the batteries (120) in the first module (100). For each valve (250) there may be one of the plurality of motors (240) that may operate, open or close, that valve (250). These features operates in a similar way as described above with reference to FIG. 4.

The EPU (220) in the second module (200) in FIG. 5 comprises a pump (290), a battery, and a motor drive controller. The battery supplies electric power to the motor drive controller, and the motor drive controller controls the pump (290) within the EPU (220). The pump (290) may have a motor driving the pump, where the motor driving the pump is controlled by the motor drive controller. The control unit (260) in the second module (200) controls the motors (240) and consequently the valves (250). The control signal for the pump (290) comes from the control module (130) in the first module (100), and these control data communication may go via the motor drive controller of the EPU (220). Power for the pump (290) may come from the batteries (120) of the first module (100) via the electric cable (300). The EPU (220) may also have a fluid tank connected to, or part of, the pump (290). The fluid tank may comprise a different fluid than the fluid in the plurality of reservoirs (210) for fluid. For example, the fluid tank may comprise a mineral oil as a fluid for the pump (290) to pump. The fluid from the EPU (220) are conducted via conduit (225) to one or more of the plurality of intensifiers (230). The intensifiers (230) may then take, via conduit (215), the fluid from the plurality of reservoirs (210) to produce high pressure fluid, that in turn can be lead via conduit (235) to one or more of the valves (250) for operating the well equipment. The fluid from the plurality of reservoirs (210) may also be used to produce low pressure fluid with the intensifiers (230). Such low pressure may be provided via the conduit (235) to one or more of the valves (250) for operating the well equipment with low pressure.

The second module (200) in FIG. 5 may have one or more batteries (270), that are electrically connected via a cable (275) to the control unit (260). Hereby the control unit (260) may receive electric power from the battery (270) in addition to, or as an alternative to, receiving electric power via cable (300) from the batteries (120) in the first module (100). The control unit (260) may control the plurality of motors (240) via a cable (265). Hereby the control unit (260) may open or close the one or more valves (250), and may therefore control and operate the well equipment. The plurality of motors (240) may be electric motors (240). In embodiments, the electric motors are electric step motors (240). Each electric motor (240) may receive electric power, via the electric cable (300), from the batteries (120) in the first module (100). For each valve (250) there may be one of the plurality of motors (240) that may operate, open or close, that valve (250). As an alternative, or as an addition, the control unit (260) may control the EPU (220) by sending communication data via a cable (266). The control module (130), and/or the control unit (260), may control the motor drive controller within the EPU (220) via the electric cable (300), and/or the cable (266). In some embodiments, the control module (130) controls directly the motor drive controller within the EPU (220). Hereby the control module (130) independently, or in combination with the control unit (260), may control the EPU (220), and the one or more of the plurality of motors (240) and allow for low or high pressure to be given through the one or more valves (250) to operate the well equipment. The control unit (260) may control each of the plurality of EPUs (220). The first module (100) may supply via the electric cable (300) electric power from the batteries (120), in the first module (100), to the plurality of EPUs (220). For clarification, no connection between the conduit (215), cable (266), and conduit (285) are made where the conduit (215), cable (266), and conduit (285) cross each other in FIG. 5.

By providing the first module (100) separate from the second module (200), and arrange each module to comprise the elements as explained above, operation of well equipment can be made without the use of an umbilical, since there is no need for an umbilical comprising an electric power line, a hydraulic power line, and a communication line. All pressurised fluid, low pressure and/or high pressure, and all electric power, as well as all the control commands, to the well equipment can be supplied by and controlled via the first module (100) and the second module (200). The modular approach allows the system and method to be adaptable towards different systems, such as for example in the well completion, tubing head, tubing head orientation joint, Vertical Xmas Tree In the Well (VXT ITW), Tubing Head Vertical Xmas Tree Tubing Head (VXT), or Horizontal Xmas Tree (HXT) systems.

According to one embodiment, the first module (100) and the second module (200) may be configured to be located within the blowout preventer, BOP, (20). Alternatively, only the second module (100), of the two modules (100, 200), may be configured to be located within the BOP (20). In a further embodiment, the second module (200) may be configured to be located below a shear ram (30) in the BOP (20). In some embodiments, the second module (200) may be configured to be located below the lowest, the dedicated, shear ram in the BOP (20). In some embodiments, the first module (100) may be configured to be located above the lowest, the dedicated, shear ram in the BOP (20). These locations of the first module (100) and the second module (200) are the locations of the modules when the system or method is in operation. These are the locations of the modules throughout the operation period subsea. Both the first module (100) and the second module (200) may be part of the landing string (40), or a simplified landing string (40). The second module (200) may be configured to be within the BOP (20) as part of the simplified landing string (40).

According to one embodiment, the well equipment may be well completion equipment, such as a tubing hanger orientation joint. According to one embodiment, the first module (100) and/or the second module (200) may comprise a protective cover. The protective cover being on the outside of each module to protect the content of each module. The protective cover may be tubular steel.

According to one embodiment, the communication data sent from the vessel or rig (10) to the communication module (110) of the first module (100) may be communicated in one or more of the following ways: through-casing communication, in-riser acoustic communication, or wired drill pipe communication. The communication data is not sent via an umbilical. The communication data may be wireless, such as the through-casing communication or the in-riser acoustic communication. Wired drill pipe communication is when a communication data wire is inside the drill pipe, inside the wall of the drill pipe. A wireless signal can be received and transmitted from and to the communication module (110) of the first module in various ways, for example, by using a remotely operated vehicle, ROV, (70). For example, the ROV (70) may be used to establish a through-casing communication to the first module (100). In this way a wireless signal from the topside can be used for remotely operating the well equipment using the first module (100) and the second module (200).

According to one embodiment, the second module (200) may comprise a battery (270) that may supplies electric power to the control unit (260). The battery (270) may supply electric power to the control unit (260) via electric cables (275), as illustrated in both FIGS. 4 and 5. While the EPU has its own battery, the battery (270) may supply the EPU and/or the electric motors (240) also. The battery (270) may supply the motor drive controller within the EPU (220) with electric power via a separate cable, or via cable (275) and cable (266), especially in a contingency case.

According to one embodiment, the second module (200) may comprise one or more annulus valves (280) for back up power, pressurised fluid, using any pressure in the annulus between the BOP (20) and the landing string (40). The annulus pressure via BOP choke and kill lines may be used to create contingency for the hydraulic control in the event something would happen, such as for example losing control over the EPU (220). This allows the system and method to use the pressurised fluid in the annulus as a back up option if the second module (200) would fail to provide pressurised fluid.

According to one embodiment, the second module (200) may be arranged within at least part of, or completely, the well equipment, well completion equipment. The second module (200) may be within a tubing hanger orientation joint, THOJ. In this way the modular approach allow the system and method to be adapted and integrated with existing equipment and processes, and exclude the need for an umbilical.

The first module (100) together with the second module (200), in the system and method for remote operation of a well equipment through a marine riser, may produce low pressure fluid and/or high pressure fluid that is controlled and supplied to one or more of the plurality of valves (250). Low pressure is pressure up to 345 bar, 30 MPa. High pressure is pressure over 345 bar, 30 MPa. In some embodiments, the pressure is up to 1024 bar, 102.4 MPa. The pump (290) in the embodiment of FIG. 4 may produce directly low or high pressure. In the embodiments where the EPU (220) is used, the EPU (220) together with the intensifier (230) in the embodiment of FIG. 5 may produce low or high pressure.

Figure 6:
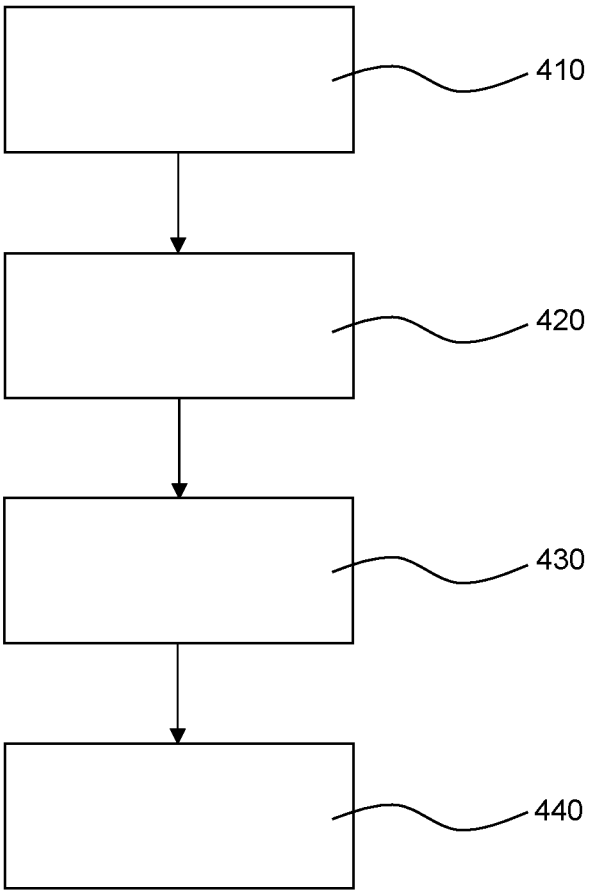
FIG. 6 is a diagrammatic illustration of a method for remote operation of a well equipment through a marine riser according to an exemplary embodiment of the present disclosure.

Turning to the method, FIG. 6 is a diagrammatic illustration of the method for remote operation of a well equipment through a marine riser, according to any one of the embodiments disclosed herein. The method steps after the first method step may be taken in any order. The method as illustrated in FIG. 6 may comprise: arranging (410) the first module (100) further away from the well head (60), or the tubing hanger, than the second module (200) along the landing string; locating (420) the first module (100) and the second module (200) within the BOP (20), as part of the landing string (40); connecting (430) and controlling hydraulic pressurised fluid to one or more tools of the well equipment via at least one valve (250) of the plurality of valves (250) of the second module (200); and communicating (440) the communication data, sent from the vessel or rig (10) to the communication module (110) of the first module (100), in one or more of the following ways: through-casing communication, in-riser acoustic communication, or wired drill pipe communication.

The method of operating a well equipment with the system according to any one of the preceding embodiments described herein, does not use an umbilical with an electric power line, a hydraulic power line, and a communication line. The method comprises: arranging (410) the first module (100) further away from the well head than the second module (200) along the landing string; and connecting (430) and controlling hydraulic pressurised fluid to one or more tools of the well equipment via at least one valve (250) of the plurality of valves (250) of the second module (200). The method may be used for installing, retrieving, and/or operating a downhole well equipment to or from the well head, tubing hanger, tubing head, or Xmas tree with the described system. The method and system uses electricity only from the first module (100) to power the second module (200) to produce hydraulic pressure, low and high pressure, to operate remotely the well equipment. The commands for operating the well equipment are sent only from the topside to the first module (100). To be clear, the disclosed system and method results in that no umbilical needs to be used. The umbilical being an umbilical with an electric power line, a hydraulic power line, and a communication line.

According to one embodiment, the well equipment may be well completion equipment. In some embodiments, the well completion equipment is a tubing hanger orientation joint. The second module (200) may be arranged within at least part of, or completely, the well equipment. The second module (200) may be within a tubing hanger orientation joint, THOJ. In this way the modular approach allow the system and method to be adapted and integrated with existing equipment and processes, and exclude the need for an umbilical.

According to one embodiment, the method may further comprise communicating (440) the communication data, sent from the vessel or rig (10) to the communication module (110) of the first module (100), in one or more of the following ways: through-casing communication, in-riser acoustic communication, or wired drill pipe communication. The communication data is not sent via an umbilical. The communication data may be wireless, such as the through-casing communication or the in-riser acoustic communication. Wired drill pipe communication may be used and is when a communication data wire is inside the drill pipe, inside the wall of the drill pipe. A wireless signal can be received and transmitted from and to the communication module (110) of the first module in various ways, for example, by using a remotely operated vehicle, ROV, (70). The ROV (70) may be used for establishing through-casing communication between the topside and the communication module (110) of the first module (100). In this way a wireless signal from the topside can be used for remotely operating the well equipment using the first module (100) and the second module (200).

According to one embodiment, the method may comprise locating (420) the first module (100) and the second module (200) within the BOP (20) by the landing string (40). The first module (100) and the second module (200) may be part of the landing string (40), or a simplified landing string (40). According to one embodiment, the method may comprise locating (420) only the second module (100) within the BOP (20) by the landing string (40). According to one embodiment, the method may comprise locating (420) the second module (200) below a shear ram (30) in the BOP (20). In some embodiments, the second module is located below the lowest shear ram in the BOP (20). The shear ram (30) may be the dedicated shear ram (30). In some embodiments, the first module (100) may be located above the lowest, the dedicated, shear ram in the BOP (20). These locations of the first module (100) and the second module (200) are the locations of the modules when the system or method is in operation. These are the locations of the modules throughout the operation period subsea.

According to one embodiment, the method may further comprise using the pressure in the annulus as a back up pressurised fluid for operating the well equipment. The one or more annulus valves (280) in the second module (200) may be used for providing back up power, pressurised fluid, using any pressure in the annulus between the BOP (20) and the landing string (40). The annulus pressure via BOP choke and kill lines may be used to create contingency for the hydraulic control in the event something would happen, such as for example losing control over the EPU (220). This allows the system and method to use the pressurised fluid in the annulus as a back up option if the second module (200) would fail to provide pressurised fluid.

According to one embodiment, the method may comprise arranging the second module (200) within at least part of, or completely within, the well equipment. The second module (200) may be arranged within a tubing hanger orientation joint, THOJ. In this way the modular approach allow the system and method to be adapted and integrated with existing equipment and processes, and exclude the need for an umbilical.

At least one embodiment disclosed herein provides a system and method for remote operation of a well equipment through a marine riser. At least one embodiment provides a system and/or a method that solves one or more of the following: move work away from the red zone; avoid hands-on clamping/handling of umbilical; avoid offshore lifting/handling of reel on/off rig; avoid routing of and damage to umbilical; reduce dropped objects due to no clamping; reduced topside footprint and rig interfaces; and/or increased weather window.

It will be apparent to those skilled in the art that various modifications and variations can be made to the system and method for remote operation of a well equipment through a marine riser. Other embodiments will be apparent to those skilled in the art from consideration of the specification and practice of the disclosed nipple. It is intended that the specification and examples be considered as exemplary only, with a true scope being indicated by the following claims and their equivalents.

LIST OF ELEMENTS

10 vessel or rig
20 BOP
30 ram
40 landing string
50 marine riser
60 well head
70 ROV
100 first module
110 communication module
120 batteries
130 control module
200 second module
210 plurality of reservoirs for fluid
215 conduit
220 plurality of EPUs
225 conduit
230 plurality of intensifiers
235 conduit
240 plurality of motors
250 plurality of valves
260 control unit
265 cable
266 cable
270 (optional) battery
275 cable
280 one or more annulus valves
285 conduit
290 one or more pumps
300 electric cable
410-440 method steps

The invention claimed is:

1. A system for remote operation of a well equipment through a marine riser, the marine riser extending between a blowout preventer (BOP) attached to a well head and a vessel or a rig at the surface, the system excluding an umbilical that would otherwise contain an electric power line, a hydraulic power line, or a communication line, the system comprising:

a first module and a second module connectable to a landing string in the marine riser, the first module including a communication module, batteries, and a control module, the second module including a plurality of reservoirs for fluid, one or more pumps, a plurality of motors, a plurality of valves, and a control unit, the control unit configured to control the plurality of motors and the plurality of valves, each valve configured to control functions of the well equipment and downhole equipment;

wherein the first module is a separate module from the second module along the landing string, the second module being configured to be closer to the well head than the first module along the landing string, wherein the communication module of the first module is configured to receive communication data for controlling the one or more tools of the well equipment, the communication data being received from the vessel or the rig at the surface, and wherein the first module and the second module are configured to have an electric cable between them, the first module supplying, via the electric cable, electric power from the batteries of the first module to the one or more pumps and the plurality of motors of the second module, and the first module supplying via the electric cable communication data from the control module of the first module to the control unit and the one or more pumps of the second module.

2. The system of claim 1, wherein the second module further comprises a plurality of electro-hydrostatic power units (EPUs) and a plurality of intensifiers, each of the plurality of EPUs comprising one of the one or more pumps, wherein the control module of the first module controls, via the electric cable, each of the plurality of EPUs, and wherein the first module supplies, via the electric cable, electric power from the batteries of the first module to the plurality of EPUs.

3. The system of claim 1, wherein the first module and the second module are configured to be located within the blowout preventer (BOP).

4. The system of claim 1, wherein only the second module among the first module and the second module is configured to be located within the BOP.

5. The system of claim 4, wherein the second module is configured to be located below a shear ram in the BOP.

6. The system of claim 5, wherein the second module is located below the lowest shear ram in the BOP.

7. The system of claim 1, wherein the well equipment is a tubing hanger orientation joint.

8. The system of claim 1, wherein at least one of the first module or the second module includes a protective cover.

9. The system of claim 1, wherein the communication data sent from the vessel or rig to the communication module of the first module is communicated through at least one of through-casing communication, in-riser acoustic communication, or wired drill pipe communication.

10. The system of claim 1, wherein the second module further comprises a battery that supplies electric power to the control unit.

11. The system of claim 1, wherein the second module further comprises one or more annulus valves for back up power using any pressure in the annulus between the BOP and the landing string.

12. The system of claim 1, wherein the second module is arranged at least part of or completely within the well equipment.

13. The system of claim 12, wherein the second module is arranged using a tubing hanger orientation joint.

14. A method of operating a well equipment without using an umbilical with an electric power line, a hydraulic power line, or a communication line, the method comprising:

arranging a first module further away from the well head than a second module along a landing string; and connecting and controlling hydraulic pressurized fluid to one or more tools of the well equipment via at least one valve among a plurality of valves of a second module.

15. The method of claim 14, wherein the well equipment is a tubing hanger orientation joint.

16. The method of claim 14, further comprising communicating communication data sent from a vessel or rig to a communication module of the first module through at least one of through-casing communication, in-riser acoustic communication, or wired drill pipe communication.

17. The method of claim 14, further comprising locating, with the landing string, either the second module or both the first module and the second module within a blowout preventer (BOP).

18. The method of claim 17, further comprising locating the second module below a shear ram in the BOP.

19. The method of claim 3, wherein the second module is located below the lowest shear ram in the BOP.

20. The method of claim 14, further comprising using the pressure in an annulus as a back up pressurised fluid for operating the well equipment.

* * * * *